US007570895B2

(12) United States Patent
Ando et al.

(10) Patent No.: US 7,570,895 B2
(45) Date of Patent: Aug. 4, 2009

(54) IMAGE FORMING APPARATUS HAVING HEAT-FIXING UNIT

(75) Inventors: Atsutoshi Ando, Yokohama (JP); Yuuichi Obara, Shizuoka-ken (JP); Hiroshi Sahara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 361 days.

(21) Appl. No.: 11/677,287

(22) Filed: Feb. 21, 2007

(65) Prior Publication Data

US 2007/0201892 A1 Aug. 30, 2007

(30) Foreign Application Priority Data

Feb. 24, 2006 (JP) ..... 2006-048999

(51) Int. Cl.
*G03G 15/20* (2006.01)

(52) U.S. Cl. ..... 399/68

(58) Field of Classification Search ..... 399/68, 399/45, 67

See application file for complete search history.

(56) References Cited

U.S. PATENT DOCUMENTS 6,816,686 B2 * 11/2004 Hooper et al. ..... 399/68
6,937,827 B2 * 8/2005 Katoh et al. ..... 399/68
7,266,316 B2 * 9/2007 Tanonaka ..... 399/68
2003/0202809 A1 * 10/2003 Tanaka ..... 399/45

FOREIGN PATENT DOCUMENTS

JP 5-039156 2/1993
JP 5-221570 8/1993
JP 7-017295 3/1995
JP 3187493 5/2001
JP 2006030407 A * 2/2006

* cited by examiner

*Primary Examiner*—Susan S Lee
(74) *Attorney, Agent, or Firm*—Fitzpatrick, Cella, Harper & Scinto

(57) ABSTRACT

An image forming apparatus includes an image forming portion; a fixing portion having a fixing nip portion which heats and fixes the unfixed image and an discharge roller which discharges the recording material, wherein in the case where the recording material is the plain paper which is equal to or larger than the predetermined size, the discharge roller conveys the plain paper in a range from a front edge to a rear edge at a predetermined speed, in the case where the recording material is the plain paper smaller than the predetermined size, the discharge roller conveys the plain paper at a first speed until the rear edge passes through the fixing nip portion, and the discharge roller conveys the plain paper at a second speed higher than the first speed after the rear edge passed through the fixing nip portion.

5 Claims, 8 Drawing Sheets

IMAGE FORMING APPARATUS HAVING HEAT-FIXING UNIT

BACKGROUND OF THE INVENTION

1. Field of the Invention

The present invention relates to an image forming apparatus such as copying apparatus, printer, or the like and, more particularly, to an image forming apparatus in which a heat-fixing unit has been provided.

2. Description of the Related Art

An image forming apparatus of an electrophotographic recording system forms a toner image onto a recording material, thereafter, executes a heat-fixing process to the toner image, and discharges the recording material onto a discharge tray. A schematic construction of a laser beam printer (LBP) as an example of such an image forming apparatus will now be described with reference to FIG. 3. The LBP illustrated in FIG. 3 is a printer for forming a monochromatic image.

In the diagram, a processing unit 101 including a photosensitive drum 102 is arranged in a main body of the image forming apparatus. A laser beam modulated according to image information is irradiated onto the photosensitive drum 102 from a laser scanner 106 and an electrostatic latent image is formed.

The processing unit 101 includes: a primary charger 103 for charging the photosensitive drum 102; a developing unit 104; a cleaning apparatus 105; and the like. Recording materials P on a feeding tray 114 are fed one by one and conveyed to the photosensitive drum 102 at predetermined timing by a registration roller 116.

The recording material P is pressed to the photosensitive drum 102 and the toner image is transferred onto the recording material P by a transfer roller 107. After that, the toner image is fixed by a heat-fixing portion 113 and the recording material P is discharged to the outside of the image forming apparatus through a discharge portion 120. In the example illustrated in the diagram, the recording material is discharged onto a discharge tray 118 provided integratedly with the apparatus main body.

Various devices for preventing such a situation that a discharge state of the recording material to be properly discharged onto the discharge tray 118 becomes incomplete are considered. One of them is a construction in which a projecting portion to kick out the recording material is formed on a peripheral surface of a roller of the discharge portion 120. The construction in which the projecting portion to kick out the recording material is formed on the peripheral surface of the roller of the discharge portion has been disclosed in each of Japanese Patent Application Laid-Open No. H05-039156, Japanese Patent No. 3187493, Japanese Patent Publication No. H07-017295, and Japanese Patent Application Laid-Open No. H05-221570.

An example of such a construction will now be described with reference to FIG. 4. The discharge portion 120 illustrated in FIG. 4 is constructed by: an discharge roller 120*a* which can rotate in the direction shown by an arrow; and a pressing roller 120*b* which is come into pressure contact with a peripheral surface of the discharge roller 120*a* by an urging unit (not illustrated). In a simplex print mode, the discharge roller 120*a* is located on an image surface side and the pressing roller 120*b* is located on a non-image surface side. The pressing roller 120*b* is driven synchronously with the driving of the discharge roller 120*a* or rotated in association with the discharge roller 120*a*.

A plurality of projecting portions 120*c* are arranged in both edge portions or near the both edge portions of the pressing roller 120*b* at predetermined intervals. Although the projecting portions 120*c* are provided for the pressing roller 120*b* in this example, there is also a case where the projecting portions are provided for the discharge roller 120*a*. In both of the above cases, the projecting portions 120*c* press a rear edge of the conveying direction of the recording material P in the discharge direction, thereby improving discharge performance of the recording material. In each of the discharge roller 120*a* and the pressing roller 120*b* illustrated in FIG. 4, a roller portion which comes into contact with the recording material is divided along the axial direction (such a roller is referred to as a divided roller). In the case of such a construction, since an area where the roller comes into contact in the image area on the recording material and an area where the roller is not come into contact occur, there is a case where a variation in glossiness of an image occurs (such a portion is called a roller mark). To suppress such a roller mark phenomenon, there is also a case of using a roller having a width wider than that of the image area of the recording material (such a roller is referred to as a non-divided roller). As illustrated in FIG. 5, a construction in which projecting portions 120*e* to kick out the recording material are provided in both edge portions of the non-divided roller is also considered. In the case of such a construction, since the projecting portions 120*e* do not rub the image on the recording material, the discharge performance can be improved while suppressing the occurrence of a defective image. Particularly, if a width of discharge roller 120*f* is set to be wider than that of the image area of the recording material P in a manner similar to a pressing roller 120*d*, the occurrence of the roller mark can be also suppressed.

If the non-divided roller having the projecting portions only in both edge portions in the axial direction is used as a roller of a discharge portion as mentioned above, the discharge performance can be improved while suppressing the occurrence of the defective image.

However, in the case of printing onto a recording material of a small size by a printer in which the non-divided roller having the projecting portions only in both edge portions in the axial direction is used as a roller of the discharge portion, since the recording material cannot be pushed out by the projecting portions, there is a possibility of deterioration of the discharge performance of the recording material of the small size. Particularly, in the case of printing onto the recording material of the small size, since control for decreasing a fixing speed is made to suppress over-rising of a temperature in an area of the fixing portion where the recording material does not pass, such a situation that the proper discharge performance cannot be assured is considered.

SUMMARY OF THE INVENTION

The invention is made in consideration of the foregoing problems and it is an object of the invention to provide an image forming apparatus which can assure discharge performance of a recording material while suppressing the occurrence of a defective image.

Another object of the invention is to provide an image forming apparatus which can assure discharge performance of a recording material of a small size while suppressing the occurrence of a defective image.

Still another object of the invention is to provide an image forming apparatus for forming an image on a recording material, comprising: an image forming portion for forming an unfixed image on the recording material; a fixing portion having a fixing nip portion which heats and fixes the unfixed image onto the recording material, wherein if the recording material is plain paper in which a size in a direction which perpendicularly crosses a conveying direction is smaller than a predetermined size, the fixing portion conveys the plain paper at a speed lower than that in the case where the recording material is plain paper in which a size in the direction which perpendicularly crosses the conveying direction is equal to or larger than the predetermined size; and an discharge roller which discharges the recording material that has passed through the fixing nip portion toward a tray and which has a projection for kicking out the recording material in an area where the plain paper smaller than the predetermined size does not pass, wherein a length of conveying path between the fixing nip portion and the discharge roller is smaller than a length in the conveying direction of the plain paper smaller than the predetermined size, and wherein in the case where the recording material is the plain paper which is equal to or larger than the predetermined size, the discharge roller conveys the plain paper in a range from a front edge to a rear edge in the conveying direction of one sheet of the plain paper at a predetermined speed, in the case where the recording material is the plain paper smaller than the predetermined size, the discharge roller conveys the plain paper at a first speed until the rear edge in the conveying direction of the plain paper passes through the fixing nip portion, and the discharge roller conveys the plain paper at a second speed higher than the first speed after the rear edge in the conveying direction of the plain paper passed through the fixing nip portion.

Further features of the present invention will become apparent from the following description of exemplary embodiments with reference to the attached drawings.

DESCRIPTION OF THE EMBODIMENTS

Exemplary embodiments for embodying the invention will be described as an example in detail hereinbelow with reference to the drawings. Dimensions, materials, and shapes of component elements, their relative layout positions, and the like disclosed in the embodiment should properly been changed according to a construction and various conditions of an apparatus to which the invention is applied and do not limit the scope of the invention to the following embodiments.

Embodiment 1

Figure 1:
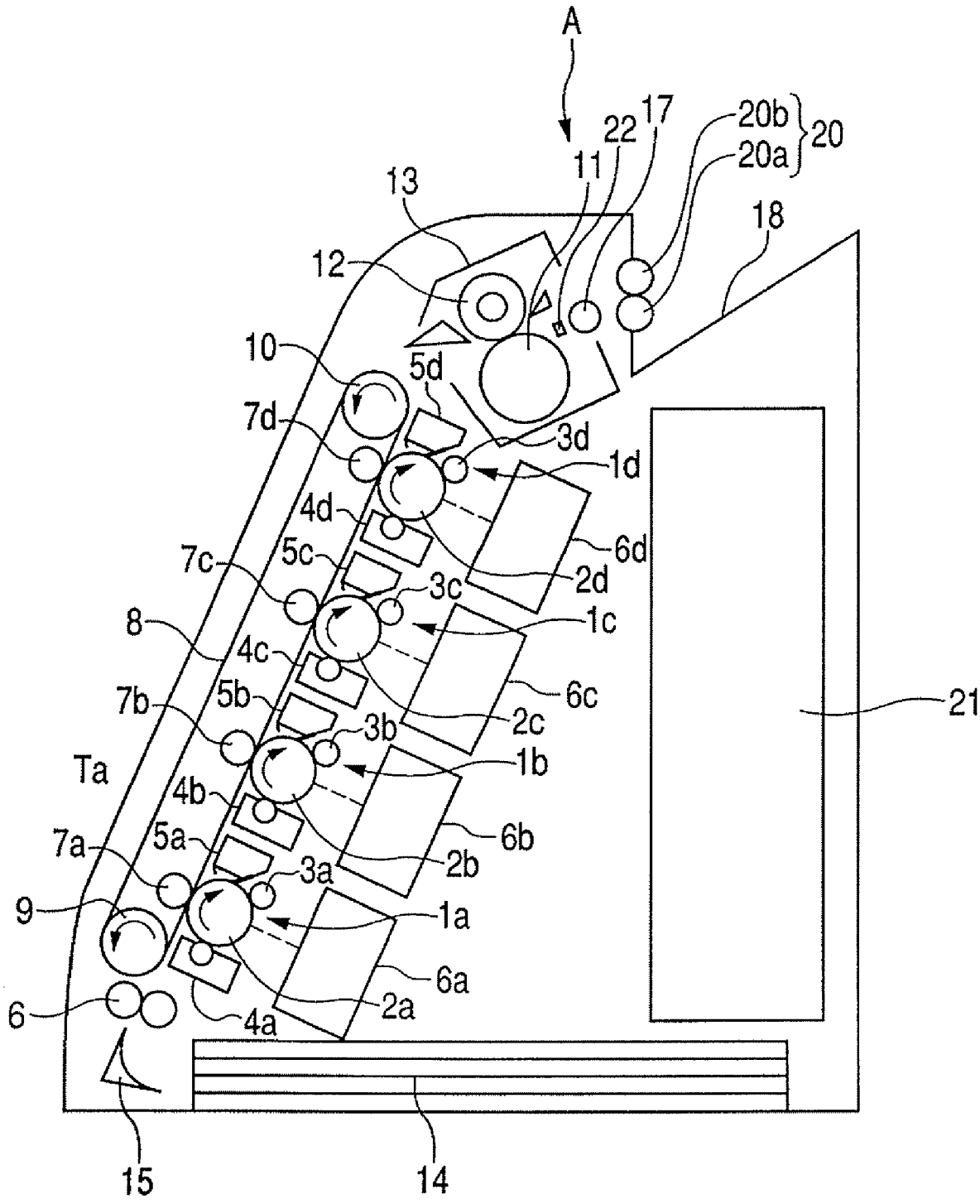
FIG. 1 is a schematic cross sectional view of an image forming apparatus in an embodiment 1 of the invention.

FIG. 1 is a schematic cross sectional view of an image forming apparatus A in an embodiment 1 of the invention. The image forming apparatus A according to the embodiment is a color image forming apparatus using an electrophotographic image forming process.

The image forming apparatus A has the following four image forming portions: an image forming portion 1*a* for forming a yellow image; an image forming portion 1*b* for forming a magenta image; an image forming portion 1*c* for forming a cyan image; and an image forming portion 1*d* for forming a black image. The four image forming portions 1*a*, 1*b*, 1*c*, and 1*d* (hereinbelow, also referred to as 1*a* to 1*d*) are arranged in a line at predetermined intervals.

Drum type electrophotographic photosensitive materials (hereinbelow, referred to as photosensitive drums) 2*a*, 2*b*, 2*c*, and 2*d* (hereinbelow, also referred to as 2*a* to 2*d*) as image bearing members are arranged in the image forming portions 1*a*, 1*b*, 1*c*, and 1*d*, respectively. Chargers 3*a*, 3*b*, 3*c*, and 3*d*, developing apparatuses 4*a*, 4*b*, 4*c*, and 4*d*, and drum cleaning apparatuses 5*a*, 5*b*, 5*c*, and 5*d* are arranged around the photosensitive drums 2*a* to 2*d*, respectively. Exposing apparatuses 6*a*, 6*b*, 6*c*, and 6*d* are arranged between the chargers 3 and the developing apparatuses 4, respectively. The chargers 3*a*, 3*b*, 3*c*, and 3*d*, the developing apparatuses 4*a*, 4*b*, 4*c*, and 4*d*, and the drum cleaning apparatuses 5*a*, 5*b*, 5*c*, and 5*d* are also shown by the chargers 3*a* to 3*d*, the developing apparatuses 4*a* to 4*d*, and the drum cleaning apparatuses 5*a* to 5*d* hereinbelow. The exposing apparatuses 6*a*, 6*b*, 6*c*, and 6*d* are also shown by the exposing apparatuses 6*a* to 6*d* hereinbelow.

Yellow toner, magenta toner, cyan toner, and black toner have been enclosed in the developing apparatuses 4*a*, 4*b*, 4*c*, and 4*d*, respectively.

Each of the photosensitive drums 2*a* to 2*d* is an OPC photosensitive material which is negatively charged, has a photoconductive layer on a drum base body made of aluminum, and is rotated at a predetermined processing speed in the direction shown by an arrow (clockwise) by a driving apparatus (not shown).

Each of the chargers 3*a* to 3*d* as charging devices uniformly charges the surface of each of the photosensitive drums 2*a* to 2*d* to a predetermined electric potential of a negative polarity by a charging bias which is applied from a charging bias power source (not shown).

Each of the developing apparatuses 4*a* to 4*d* deposits the toner of each color onto each of electrostatic latent images formed on the photosensitive drums 2*a* to 2*d* and develops (visualizes) as a toner image. As a developing method by the developing apparatuses 4*a* to 4*d*, for example, it is possible to use a 2-component contact developing method whereby a material obtained by mixing magnetic carriers to toner particles is used as a developer and conveyed by a magnetic force and the latent image is developed in the contact state with each of the photosensitive drums 2*a* to 2*d*.

Transfer rollers 7*a*, 7*b*, 7*c*, and 7*d* (hereinbelow, also referred to as 7*a* to 7*d*) as transfer units are made by elastic members and are in contact with the photosensitive drums 2*a* to 2*d* through a recording material conveying belt (hereinbelow, also referred to as a transfer belt) 8 in an endless belt shape in transfer nip portions, respectively.

Although the transfer roller 7 is used as a transfer unit here, it is also possible to use a transfer blade to which a high voltage is applied when the toner image is transferred onto the recording material and which is come into contact with the transfer belt 8.

The drum cleaning apparatuses 5*a* to 5*d* remove the transfer residual toner remaining on the surfaces of the photosensitive drums 2*a* to 2*d* and collect them, respectively.

In the exposing apparatuses 6*a* to 6*d*, a laser beam modulated according to the image information is output from a laser output unit (not shown) and exposes the surfaces of the photosensitive drums 2*a* to 2*d* through a polygon mirror (not shown) which rotates at a high speed. Thus, the electrostatic latent images of the respective color according to the image information are formed onto the surfaces of the photosensitive drums 2*a* to 2*d* which have been charged by the chargers 3*a* to 3*d*, respectively.

The transfer belt 8 is suspended between a driving roller 9 and a tension roller 10 and rotated (moved) in the direction shown by an arrow (counterclockwise) by the driving of the driving roller 9. The transfer belt 8 is made of a dielectric resin such as polycarbonate, polyethylene terephthalate resin film, or polyvinylidene fluoride resin film.

A fixing apparatus 13 as an image heating unit (fixing portion) having a pressing roller 12 and a fixing film 11 which contains a heat source therein is arranged on the downstream side of the recording material conveying direction of the transfer belt 8.

The image forming operation by the image forming apparatus A will now be described.

When an image creation start signal is generated, the photosensitive drums 2*a* to 2*d* of the four image forming portions 1*a* to 1*d* which are rotated at a predetermined processing speed are uniformly charged to the negative polarity by the chargers 3*a* to 3*d*, respectively. In the exposing apparatuses 6*a* to 6*d*, an image signal of an output image is converted into a photosignal by the laser output unit (not shown) and the laser beam as a converted photosignal scans and exposes the charged surfaces of the photosensitive drums 2*a* to 2*d*, thereby forming the electrostatic latent images, respectively.

A developing bias of the same polarity as the charging polarity (negative polarity) of the photosensitive drum 2*a* is applied to the developing apparatus 4*a*. The yellow toner is first deposited by the developing apparatus 4*a* onto the electrostatic latent image formed on the photosensitive drum 2*a* and is visualized as a toner image.

The recording material (sheet) P which is fed from a feeding cassette 14 through a recording material conveying guide 15 is conveyed to a transfer portion Ta between the photosensitive drum 2*a* and the transfer roller 7*a* by a registration roller 16 synchronously with the timing when a front edge of the toner image on the photosensitive drum 2*a* is moved to the transfer portion Ta.

The yellow toner image is transferred onto the recording material P conveyed to the transfer unit by the transfer roller 7*a* to which a transfer bias (the polarity (positive polarity) opposite to that of the toner) has been applied.

The recording material P to which the yellow toner image has been transferred is moved to the image forming portion 1*b* by the transfer belt 8.

Also in a transfer portion constructed by the image forming portion 1*b* and the transfer roller 7*b*, the magenta toner image formed on the photosensitive drum 2*b* is overlaid and transferred onto the yellow toner image on the recording material P in a manner similar to the foregoing transfer portion.

In respective transfer portions, the cyan and black toner images formed on the photosensitive drums 2*c* and 2*d* of the image forming portions 1*c* and 1*d* are sequentially overlaid onto the yellow and magenta toner images which have been overlaid and transferred onto the recording material P in a manner similar to the above, thereby forming a full-color toner image onto the recording material P.

The recording material P on which the full-color toner image has been formed is conveyed to the fixing apparatus 13, heated and pressed in the fixing nip between the fixing film 11 and the pressing roller 12, thermally fixed onto the surface of the recording material P, and thereafter, discharged. In the fixing apparatus, since a motive power of a motor M has been applied to the pressing roller 12 (refer to FIG. 9), the fixing film 11 rotates in association with the rotation of the pressing roller 12. Although not shown, a ceramic heater is in contact with the inner surface of the fixing film and a fixing nip portion is formed by the ceramic heater and the pressing roller so as to sandwich the fixing film therebetween.

In the discharge portion, the recording material P is discharged onto a discharge tray 18 by a discharge roller pair 20 as a discharge portion which is driven by the same driving source M (refer to FIG. 9) as that of the fixing apparatus 13 while a discharge angle is restricted by a discharge angle restricting roller 17. A series of image forming operation is finished.

Since a discharge sensor (detecting unit) 22 is provided between the fixing nip portion and the discharge angle restricting roller 17, the front edge and the rear edge of the recording material P can be detected. Information from the discharge sensor is transmitted to a control unit 21 (illustrated in FIGS. 1 and 9) as a controller. The control unit 21 controls the driving unit M by using a signal from the discharge sensor 22 as a trigger, thereby controlling a driving speed of the fixing apparatus 13 and the discharge roller pair 20. Thus, a conveying speed of the recording material which is conveyed by the fixing apparatus 13 and the discharge roller pair 20 is controlled.

When the images are transferred onto the recording material from the photosensitive drums, the transfer residual toner remaining on the photosensitive drums 2*a* to 2*d* is removed by the drum cleaning apparatuses 5*a* to 5*d* and collected, respectively.

A construction of the fixing portion 13 and the discharge unit 20 of the image forming apparatus of the embodiment and their control will now be described.

Figure 9:
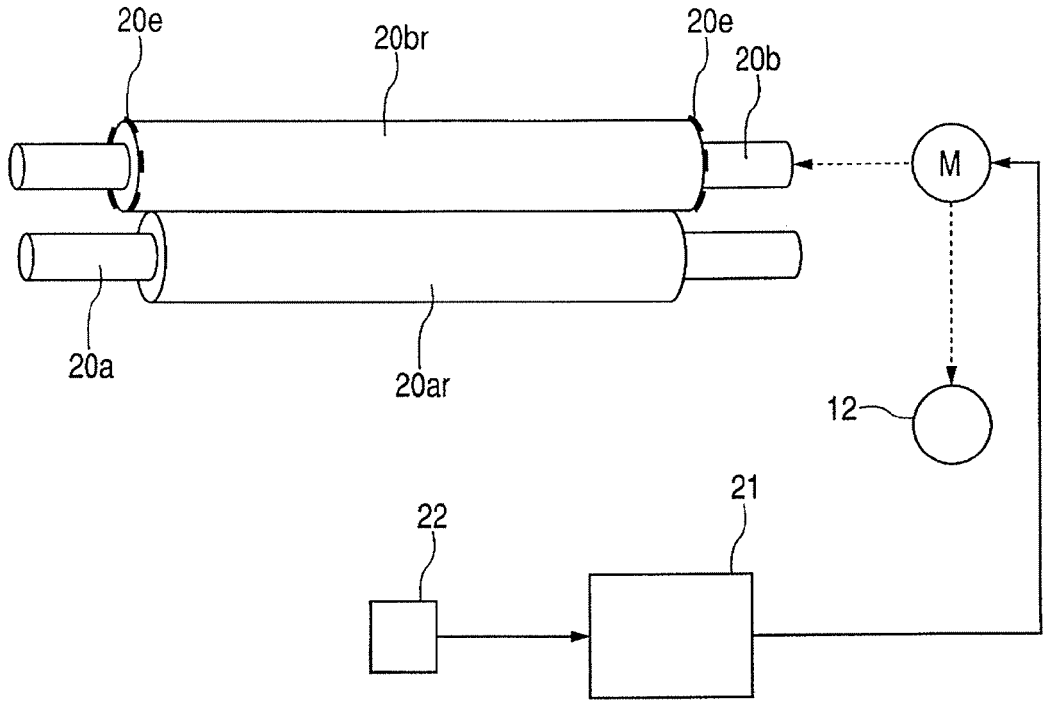
FIG. 9 is a diagram illustrating a relation of a driving transfer from a motor to a fixing portion and an discharge roller pair and a relation of a control signal transfer from a control unit to the motor.
Figure 10:
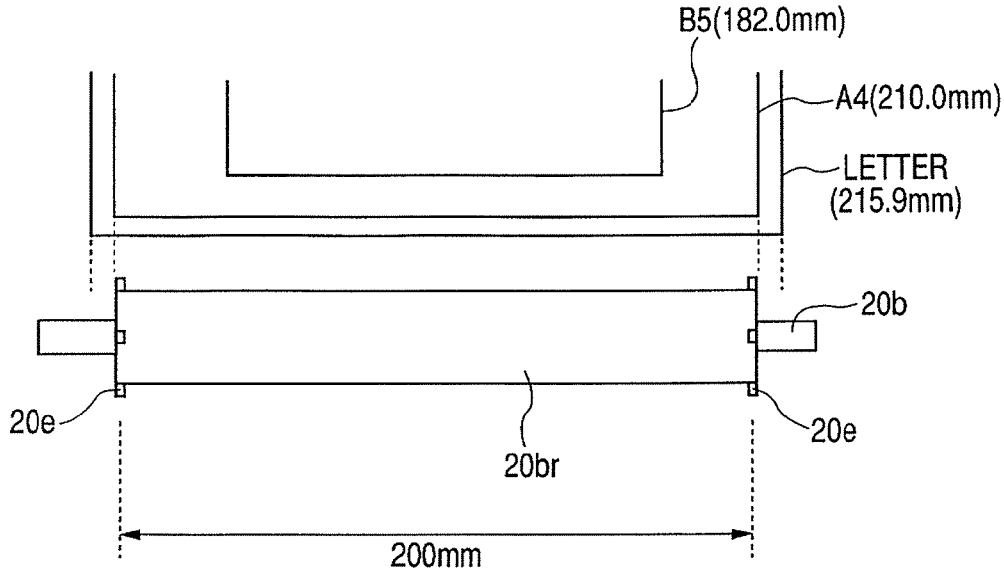
FIG. 10 is a diagram illustrating a relation between an interval between projecting portions in both edge portions of the discharge roller and a size of plain paper.

FIG. 9 is a diagram illustrating a relation of the driving transfer from the motor M to the fixing portion 13 and the discharge roller pair 20 and a relation of a control signal transfer from the control unit 21 to the motor M. FIG. 10 is a diagram illustrating a relation between an interval between projecting portions 20*e* in both edge portions of the discharge roller and a size of plain paper.

FIGS. 6A to 6D are diagrams illustrating speed control of the discharge roller in the case of printing onto the plain paper of a size which is equal to or larger than a predetermined size (A4 size) (first print mode). FIGS. 7A to 7D are diagrams illustrating speed control of the discharge roller in the case of printing onto a resin sheet such as an OHT (second print mode). FIGS. 8A to 8D are diagrams illustrating speed control of the discharge roller in the case of printing onto plain paper of a size smaller than the predetermined size (A4 size) (third print mode).

As will be understood with reference to FIG. 9, the discharge unit 20 is constructed by a first discharge roller 20*a* and a second discharge roller 20*b*. The first discharge roller 20*a* is a non-divided roller provided on the side which is come into contact with the image surface in the simplex print mode. A roller portion 20*ar* of the first discharge roller 20*a* is an area which is come into contact with the recording material. The first discharge roller 20*a* has a rubber layer around a metal axis and a fluororesin layer is provided on the surface. By providing the fluororesin layer, the deposition of the toner onto the discharge roller is suppressed.

The second discharge roller 20*b* is a non-divided roller provided on the side which is not come into contact with the image surface in the simplex print mode. A roller portion 20*br* of the second discharge roller 20*b* is an area which is come into contact with the recording material. The second discharge roller 20*b* has a rubber layer around a metal axis and this rubber layer is exposed. The projecting portions 20*e* to kick out the recording material are formed in both edge portions of the roller portion 20*br*.

The motive power of the motor M has been applied to the second discharge roller 20*b*. Since the discharge unit 20 has the construction in which the second discharge roller 20*b* whose rubber layer is exposed is driven and the first discharge roller 20*a* whose surface is covered with the fluororesin layer is driven in association with the second discharge roller, the recording material can be strictly gripped by the rubber layer and conveyed. Therefore, the discharge performance can be improved while suppressing the deposition of the toner.

The motive power of the motor M has been also applied to the pressing roller 12 of the fixing portion 13. When a rotational speed of the motor M changes, rotational speeds of the discharge roller pair (20*a*, 20*b*) and the fixing roller pair (the fixing film 11, the pressing roller 12) also change.

As illustrated in FIG. 10, although the projecting portions 20*e* provided for the second discharge roller 20*b* act on the recording material of the A4 size or the letter size, they do not act on the recording material of the B5 size. An interval (200 mm) between the projecting portions 20*e* is narrower than the recording material (210 mm) of the A4 size (predetermined (reference) size in the embodiment) but is wider than the image area of the recording material of the A4 size.

A length of conveying path between the fixing nip portion and the discharge roller is shorter than a length in the conveying direction of the plain paper smaller than the predetermined size (A4 size in the embodiment).

In the image forming apparatus in the embodiment, a driving speed of the fixing apparatus 13 in the print mode (second print mode) in the case of printing to an OHT (overhead transparency) film or a resin film is set to be slower than that in the print mode (first print mode) in the case of printing to the plain paper whose size in the direction (axial direction of the discharge roller) which perpendicularly crosses the conveying direction is equal to or larger than the predetermined size (A4 size in the embodiment). This is because in the case of the OHT or resin film, a heat capacity is larger than that of the plain paper and a larger heat capacity is necessary to fix, and further, in the case of forming a color image onto the OHT, it is necessary to sufficiently melt the toner and to obtain high permeability.

In the embodiment, the pressing roller 12 is driven at a speed of 40% of the driving speed (normal recording material conveying speed: 100%) in the case printing to the plain paper of the predetermined size or larger. Further, when the OHT is made to pass, since an amount of heat which is taken from the fixing film 11 and the pressing roller 12 upon passing is large, it is necessary to sufficiently accumulate the heat into the fixing film 11 and the pressing roller 12. Therefore, control (throughput-down) for setting a passing interval of the recording material P is set to be wider than that upon normal sheet passing and reducing the number of sheets which pass per minute is made. The throughput-down is performed by a method whereby the control unit (control unit 21 in the embodiment) for controlling the image forming operation controls the timing for feeding the recording material toward the image forming portion 1*a* from the feeding cassette 14.

Similarly, in the case of printing (third print mode) to the recording material P of a small size (plain paper smaller than the predetermined size), only in the center portion of the fixing apparatus 13, the heat of the fixing film 11 and the pressing roller 12 is taken by the sheet passage. The edge portion of the fixing apparatus 13 is continuously heated in the state where the heat is not taken by the recording material. Therefore, if the sheet passage is continued at a throughput similar to that upon printing of the plain paper which is equal to or larger than the predetermined size, there is a possibility that the edge portion of the fixing apparatus 13 is damaged by the overheat.

Particularly, it has been known that if the driving speed of the fixing apparatus 13 is high, since the time during which the recording material P passes through the fixing nip portion is short, it is necessary to set a temperature of the fixing nip portion to be higher, so that a temperature difference between the center portion and the edge portion increases.

Therefore, in the embodiment, the throughput-down control is made even at the time of the sheet passage of the recording material P of the small size. In this instance, the driving speed of the fixing apparatus 13 is set to be slower than the normal speed (normal recording material conveying speed: 100%) and the passing interval of the recording material P is set to be wider than that upon normal sheet passing. Until the temperature difference between the center portion and the edge portion is uniformed in the fixing apparatus 13, the fixing apparatus 13 is rotated without performing the sheet passage. After the temperature difference between the center portion and the edge portion is uniformed to a certain extent, the next recording material P is made to pass. In the embodiment, a fixing speed (rotational speed of the pressing roller 12) in the third print mode is controlled so as to be 80% of the speed in the first print mode.

The recording material P of the small size denotes the recording material of the B5 size or the like whose width is narrower than the maximum sheet passage width (A4 size) of the image forming apparatus. The width denotes a length in the width direction which perpendicularly crosses the recording material conveying direction on the surface of the recording material.

The control unit 21 increases the speed of the motor M after the elapse of a predetermined time (after the rear edge of the recording material P passed through the fixing nip portion) after the discharge sensor 22 detected the front edge of the recording material P. In the embodiment, the motor speed is raised to a fixing speed when the plain paper of the A4 size or larger is fixed. That is, the motor speed is raised to 125% in the case of the plain paper of the small size and it is raised to 250% in the case of the OHT.

Figure 6A:
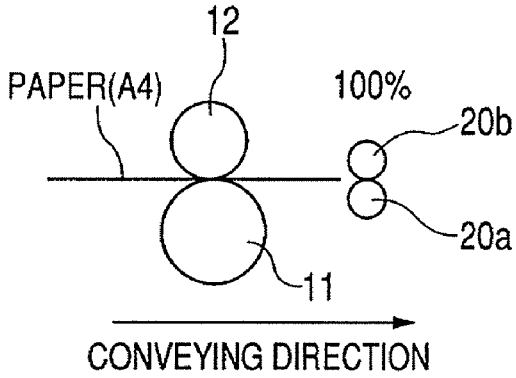
FIGS. 6A, 6B, 6C and 6D are diagrams illustrating speed control of the discharge roller in the case of printing onto plain paper of a size which is equal to or larger than a predetermined size (A4 size).
Figure 6B:
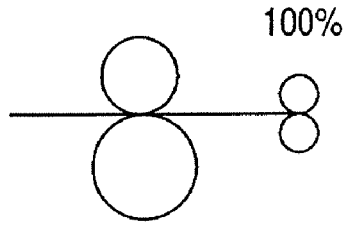
Figure 6C:
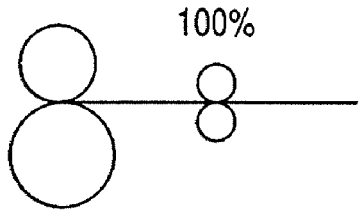
Figure 6D:
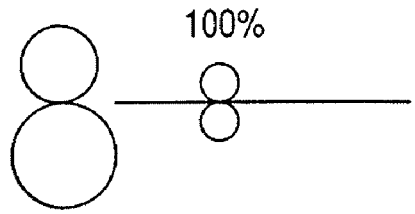
Figure 7A:
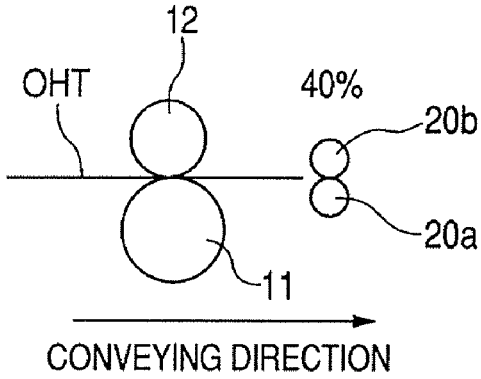
FIGS. 7A, 7B, 7C and 7D are diagrams illustrating speed control of the discharge roller in the case of printing onto a resin sheet.
Figure 7B:
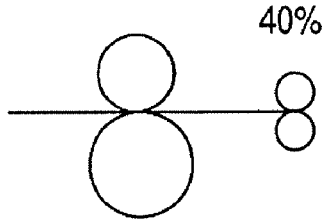
Figure 7C:
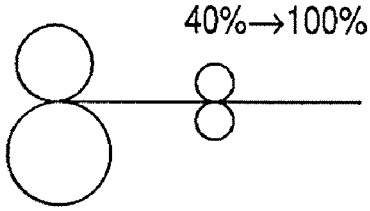
Figure 7D:
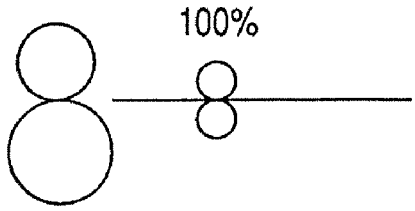
Figure 8A:
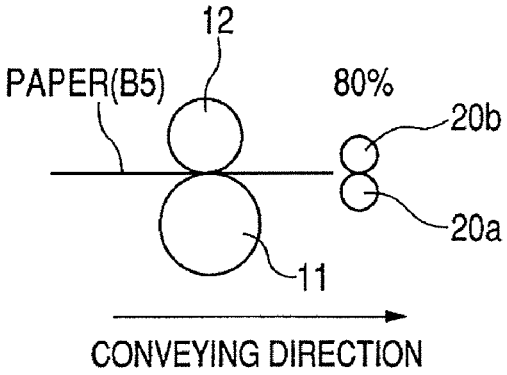
FIGS. 8A, 8B, 8C and 8D are diagrams illustrating speed control of the discharge roller in the case of printing onto plain paper of a size smaller than the predetermined size (A4 size).
Figure 8B:
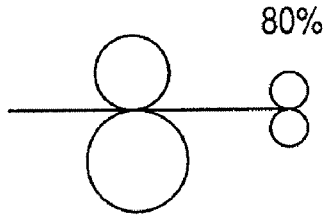
Figure 8C:
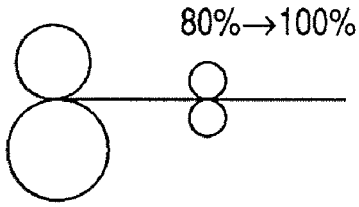
Figure 8D:
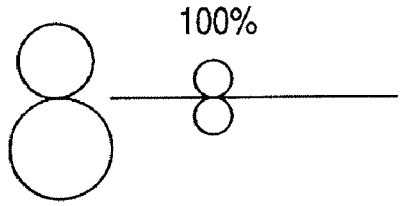

FIGS. 6A to 6D, 7A to 7D, and 8A to 8D illustrate deviation of the speed control in the three print modes, respectively. As illustrated in FIGS. 6A to 6D, in the case of printing onto the plain paper of the predetermined size or larger, the pressing roller 12 is controlled at a speed of 100%. In this instance, the pressing roller 20*b* also rotates at a speed of 100%. FIGS. 6A to 6D illustrate the case of printing onto the plain paper of the A4 size (first print mode). FIGS. 7A to 7D illustrate the case of printing onto the resin sheet (second print mode). FIGS. 8A to 8D illustrate the case of printing onto the plain paper of the B5 size (third print mode). FIGS. 6A, 7A, and 8A illustrate the timing when the recording material has passed through the fixing nip portion but does not reach the discharge roller pair (that is, the discharge roller pair). FIGS. 6B, 7B, and 8B illustrate the timing when the front edge of the recording material has reached the discharge roller pair. FIGS. 6C, 7C, and 8C illustrate the timing just after the rear edge of the recording material came out of the fixing nip portion. FIGS. 6D, 7D, and 8D illustrate the timing just after the rear edge of the recording material has completely come out of the fixing nip portion.

As illustrated in FIGS. 6A to 6D, in the first print mode, the fixing roller pair and the discharge roller pair always rotate at the speed of 100%.

As illustrated in FIGS. 7A to 7D, in the second print mode, the fixing roller pair and the discharge roller pair rotate at the speed of 40% (third speed) during the fixing process (FIGS. 7A to 7C). However, just after the rear edge of the resin sheet came out of the fixing nip portion (timing of FIG. 7C), the speed of the fixing roller pair and the discharge roller pair is changed from the speed of 40% to the speed of 100% (fourth speed).

As illustrated in FIGS. 8A to 8D, in the third print mode, the fixing roller pair and the discharge roller pair rotate at the speed of 80% (first speed) during the fixing process (FIGS. 8A to 8C). However, just after the rear edge of the resin sheet came out of the fixing nip portion (timing of FIG. 8C), the speed of the fixing roller pair and the discharge roller pair is changed from the speed of 80% to the speed of 100% (second speed). In the embodiment, the third speed is set to be slower than the first speed the fourth speed is set to the same speed as the second speed.

As mentioned above, the image forming apparatus in the embodiment has: the image forming portions (1*a* to 1*d*) to form the unfixed images onto the recording material; and the fixing portion 13 having the fixing nip portion for heat-fixing the unfixed images onto the recording material. If the recording material is the plain paper whose size in the direction which perpendicularly crosses the conveying direction is smaller than the predetermined size (A4 size in the embodiment), the fixing portion conveys the plain paper at a speed lower than the speed in the case where the recording material is the plain paper whose size in the direction which perpendicularly crosses the conveying direction is equal to or larger than the predetermined size. The image forming apparatus has the discharge roller 20*b* for discharge the recording material which has passed through the fixing nip portion toward the tray 18. The discharge roller has the projections 20*e* for kicking out the recording material into the area where the plain paper of the size (for example, B5 size) smaller than the predetermined size does not pass. The length of conveying path between the fixing nip portion and the discharge roller is smaller than the length in the conveying direction of the plain paper smaller than the predetermined size. In the case where the recording material is the plain paper which is equal to or larger than the predetermined size, the discharge roller conveys the plain paper in the range from the front edge to the rear edge in the conveying direction of one sheet of the plain paper at the predetermined speed. In the case where the recording material is the plain paper smaller than the predetermined size, the discharge roller conveys the plain paper at the first speed until the rear edge in the conveying direction of the plain paper passes through the fixing nip portion. The discharge roller conveys the plain paper at the second speed higher than the first speed after the rear edge in the conveying direction of the plain paper passed through the fixing nip portion.

With such a construction, the image forming apparatus which can assure the discharge performance of the recording material while suppressing the occurrence of the defective image can be provided.

Further, in the embodiment, if the recording material is the resin sheet, the discharge roller conveys the resin sheet at the third speed until the rear edge in the conveying direction of the resin sheet passes through the fixing nip portion. The discharge roller conveys the resin sheet at the fourth speed higher than the third speed after the rear edge in the conveying direction of the resin sheet passed through the fixing nip portion.

After rear edge of the recording material P passed through the discharge roller pair 20, the control unit 21 returns the driving speed of the fixing apparatus 13 to the normal speed (the speed is changed from 100% to 40% in the case of the second print mode; the speed is changed from 100% to 80% in the case of the third print mode; the speed of 100% is maintained in the case of the first print mode). After the speed was returned to the normal fixing speed, the fixing apparatus 13 is controlled by the control unit 21 so that the next recording material P enters the fixing nip portion after completion of preparation for fixing the next recording material P.

With the above construction, the defective discharge in which the rear edge of the recording material remains in the discharge portion and a jam of the recording material which is caused in association with the defective discharge can be prevented.

As described above, according to the embodiment, even in the case of using the non-divided roller in order to improve the picture quality, by making the speed control in the discharge portion, the apparatus which satisfies discharge stacking performance by the simple construction in which the fixing portion and the discharge portion are driven by the same driving source can be obtained.

Particularly, in the special recording materials such as OHT, resin film, and small-size recording material in which it is necessary to raise the speed upon discharge, the control to deteriorate the throughput upon fixing has often already been implemented. That is, upon sheet passage of one of the OHT and the resin film, since the heat capacity of the recording material is large, it is necessary to accumulate the heat of a certain amount into the fixing apparatus by extending the sheet passing interval between the recording material. Therefore, the throughput is ordinarily deteriorated as compared with the case of passing the plain paper. In the recording material of the small size, in order to prevent such a situation that, upon fixing, the heat only in the center portion of the image forming apparatus is taken by the recording material and the temperature of the edge portion of the fixing apparatus rises, it is necessary to make the control for deteriorating the throughput.

Therefore, by using the embodiment, the excellent discharge stacking performance can be obtained for various kinds of media without substantially deteriorating the performance of the image forming apparatus upon passage of the plain paper.

Although the fixing apparatus for heat-fixing the unfixed toner image has been used as an image heating unit in the embodiment, it is merely an example of the image heating apparatus and the invention is not limited by such a fixing apparatus. For example, what is called a gloss finisher or the like which improves the glossiness by further heating and smoothing the fixed toner image can be also used as an image heating apparatus. The invention is not limited to the fixing portion using the fixing film and the ceramic heater but can be also applied to an image forming apparatus having a heat roller type fixing portion using a halogen lamp. Although the predetermined size (reference size) has been set to the A4 size in the embodiment, another size may be set to the predetermined size (reference size).

Although the fixing speed upon OHT passage has been set to 40% of that of the plain paper of the A4 size and the fixing speed upon passage of the plain paper of the small size has been set to 80% of that of the plain paper of the A4 size in the embodiment, the fixing speed is not limited to such speeds. Although the speed after the speed increase has been set to the same speed as that upon passage of the plain paper of the A4 size in the embodiment, the invention is not limited to such a speed. The speed can be also raised to a speed higher than the speed upon passage of the plain paper of the predetermined size or larger and can be changed within a range where the sufficient discharge stacking performance is obtained.

Particularly, when the recording material such as OHT or resin film is made to pass, by raising the speed to the speed higher than the speed upon passage of the plain paper of the predetermined size, the better discharge stacking performance can be obtained. This is because since the resin film or the like is softened by the heat that is given by the fixing, "rigidity" of the recording material at the discharge point of time is often smaller than that of the plain paper.

With respect to the recording material of the small size, unlike the case of the plain paper of the predetermined size or larger, since the kick-out effect by the kick-out member existing in the edge portion of the discharge portion is not obtained, it is often disadvantageous from a viewpoint of the discharge stacking performance as compared with the plain paper of the predetermined size or larger. Therefore, the process for raising the speed to the speed higher than the speed upon passage of the plain paper of the predetermined size or larger is also effective upon passage of the plain paper of the small size.

Whether or not the recording material which is made to pass is one of the OHT, the resin film, and the recording material of the small size can be discriminated as follows. For example, the following construction can be used. A selecting unit (for example, selection button) for allowing the user to select the recording material type is provided for the apparatus main body. If the user selects the preset mode corresponding to one of the OHT, the resin film, and the recording material of the small size, one of the second print mode and the third print mode is automatically set. The following construction can be also used. A detecting unit for detecting the recording material type is provided. When the detecting unit detects that the recording material which is made to pass is one of the OHT, the resin film, and the recording material of the small size, one of the second print mode and the third print mode is automatically set.

It is sufficient that the discharge roller pair 20 has at least a pair of the discharge roller (first discharge roller) 20*a* and the pressing roller (second discharge roller) 20*b* which is come into pressure contact with the peripheral surface of the discharge roller 20*a* by the urging unit (not shown). It is desirable that at least one of the discharge roller 20*a* and the pressing roller 20*b* is the non-divided roller which has the contact surface wider than the image area of the recording material (which is come into contact with the whole image area).

Although the embodiment has been described on the assumption that the control unit 21 controls the image forming operation of the image forming apparatus A, as a control unit for making the drive control of the fixing apparatus 13 and the discharge roller pair 20, a control unit can be also provided separately from the control unit for controlling the image forming operation.

Embodiment 2

Figure 2:
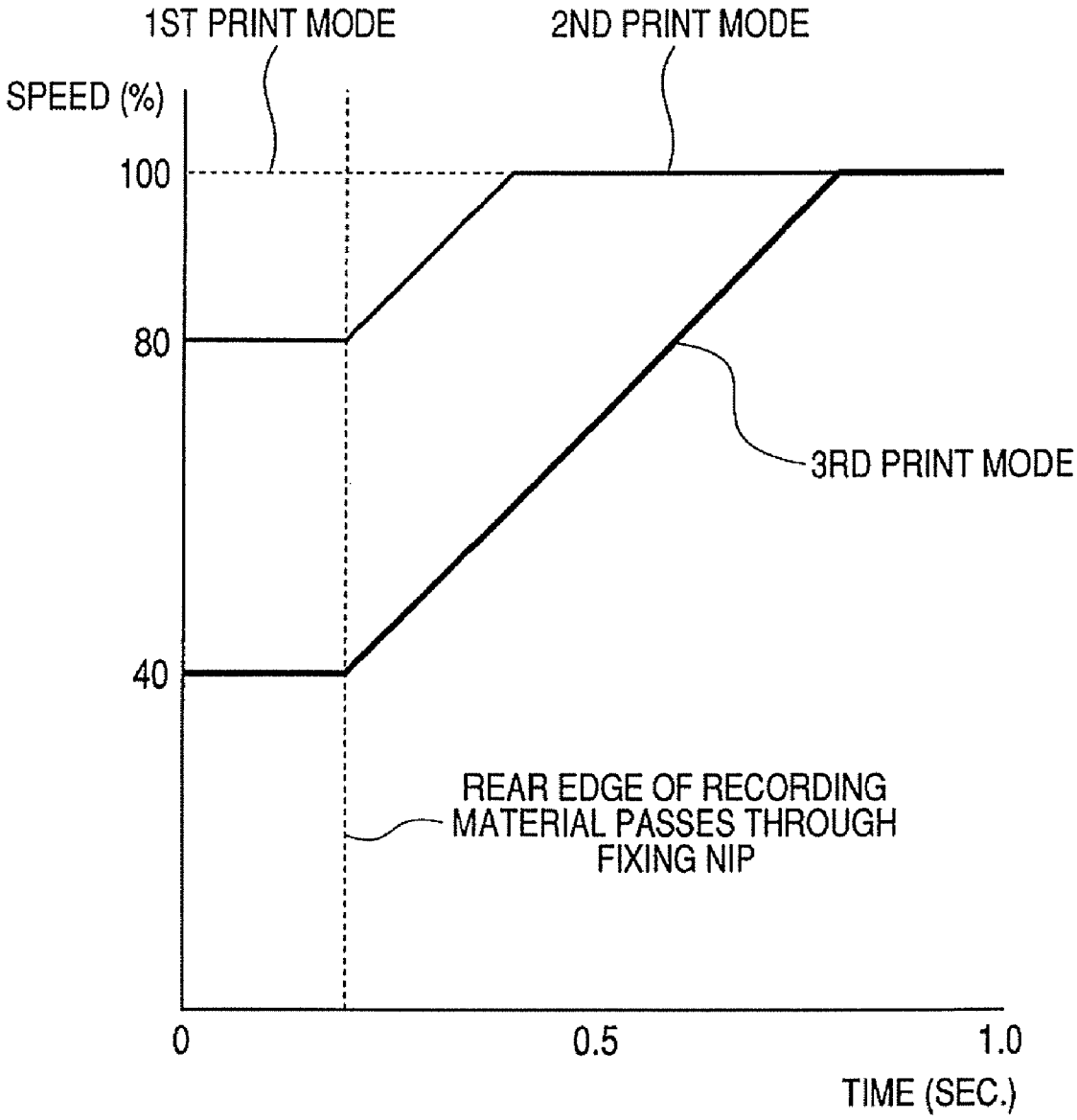
FIG. 2 is a diagram showing a method of increasing a speed in an embodiment 2 of the invention.
Figure 3:
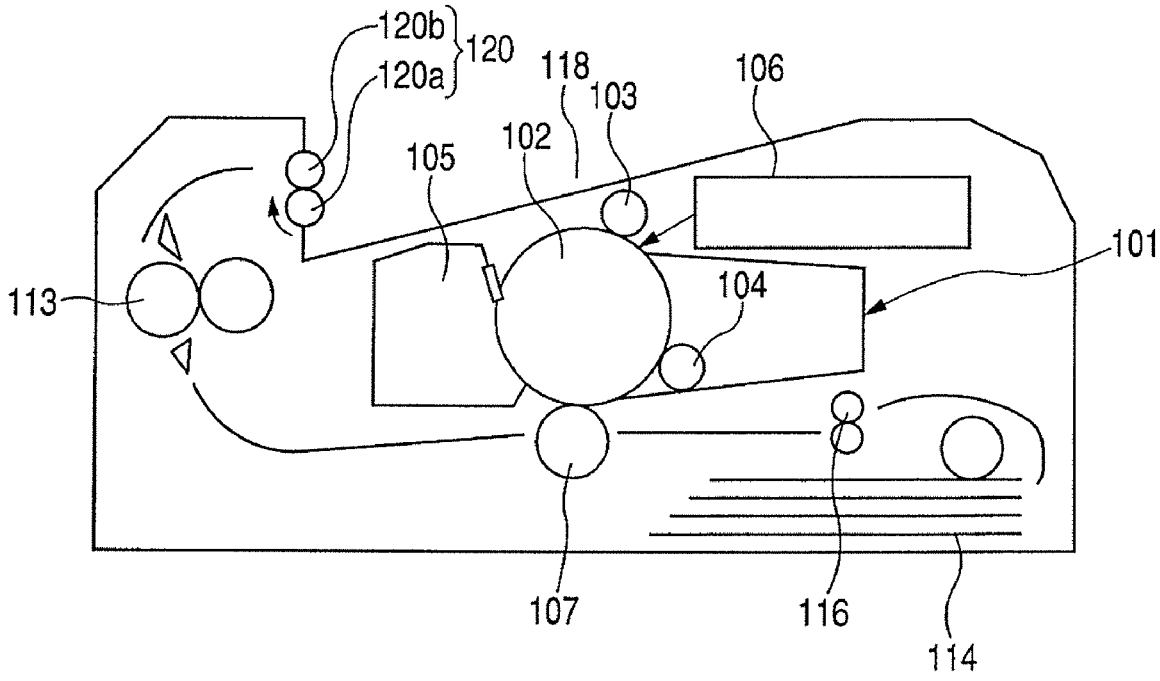
FIG. 3 is a schematic cross sectional view of a conventional image forming apparatus.
Figure 4:
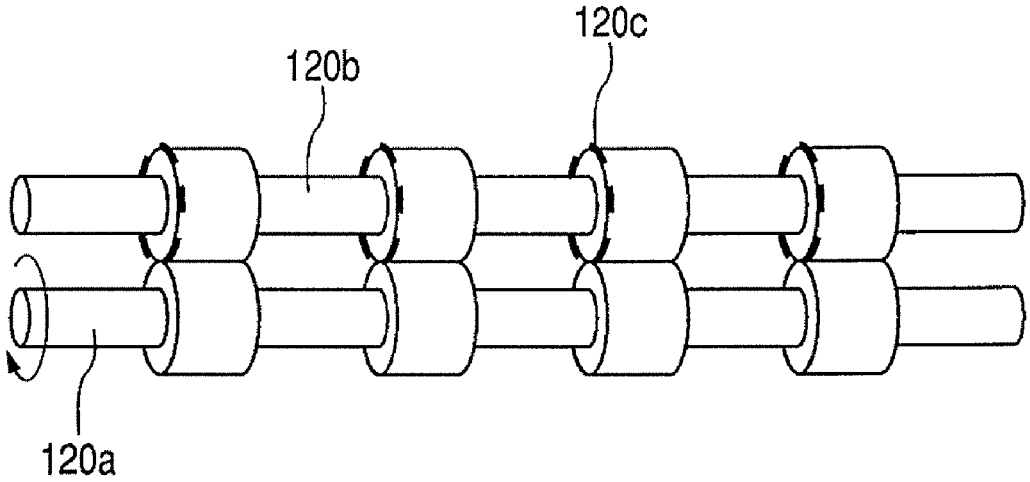
FIG. 4 is a schematic diagram of an discharge roller (divided roller).
Figure 5:
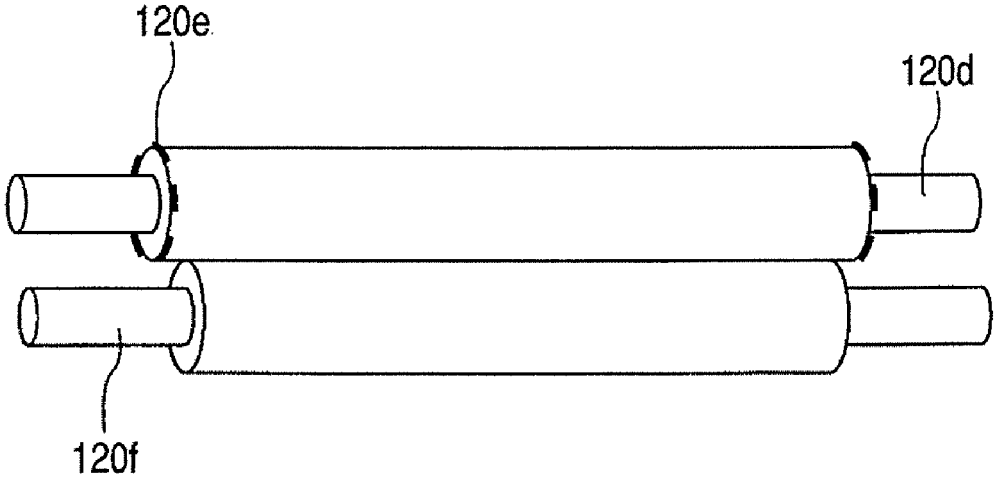
FIG. 5 is a schematic diagram of an discharge roller (non-divided roller).

An image forming apparatus according to an embodiment 2 of the invention differs from the image forming apparatus A according to the embodiment 1 mentioned above with respect to a point that control is made so as to gradually raise the speed when the conveying speed of the fixing portion and the discharge portion is switched after the recording material passed through the fixing nip portion. FIG. 2 is a diagram for describing a speed increasing method in the embodiment 2.

If the speed is suddenly switched, there is a fear that the recording material is hooked to the discharge tray due to a shock of the speed switching and a rounding phenomenon of the recording material occurs therefrom as a start point.

In the image forming apparatus of the embodiment, as illustrated in FIG. 2, the control unit 21 continuously changes the speed of the fixing apparatus 13 and the discharge roller pair 20 at a speed increasing rate of 10% of the speed in the first print mode per about 0.1 second until the speed reaches the speed upon passage of the plain paper of the A4 size. That is, upon passage of the small-size plain paper, the speed is raised for a time of 0.2 second. Upon passage of the OHT sheet, the speed is raised for a time of 0.6 second. The speed upon passage of the plain paper of the A4 size corresponds to the speed of 100% illustrated in FIG. 2.

By using the construction of the embodiment, in addition to the effect described in the embodiment 1, no shock occurs upon speed switching and the recording material can be smoothly stacked to the discharge portion.

Although the speed is continuously changed as illustrated in FIG. 2 in the embodiment, the invention is not limited to such a change so long as the speed changes gradually. For example, the speed can also change step by step through a plurality of levels.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-048999, filed Feb. 24, 2006, which is hereby incorporated by reference herein in its entirety.

What is claimed is:

1. An image forming apparatus for forming an image on a recording material, comprising:

an image forming portion for forming an unfixed image on the recording material;

a fixing portion having a fixing nip portion which heats and fixes the unfixed image onto the recording material, wherein if the recording material is plain paper in which a size in a direction which perpendicularly crosses a conveying direction is smaller than a predetermined size, the fixing portion conveys the plain paper at a speed lower than that in the case where the recording material is plain paper in which a size in the direction which perpendicularly crosses the conveying direction is equal to or larger than the predetermined size; and a discharge roller which discharges the recording material that has passed through the fixing nip portion toward a tray and which has a projection for kicking out the recording material in an area where the plain paper smaller than the predetermined size does not pass, wherein a length of conveying path between the fixing nip portion and the discharge roller is smaller than a length in the conveying direction of the plain paper smaller than the predetermined size, and wherein in the case where the recording material is the plain paper which is equal to or larger than the predetermined size, the discharge roller conveys the plain paper in a range from a front edge to a rear edge in the conveying direction of one sheet of the plain paper at a predetermined speed, in the case where the recording material is the plain paper smaller than the predetermined size, the discharge roller conveys the plain paper at a first speed until the rear edge in the conveying direction of the plain paper passes through the fixing nip portion, and the discharge roller conveys the plain paper at a second speed higher than the first speed after the rear edge in the conveying direction of the plain paper passed through the fixing nip portion.

2. An apparatus according to claim 1, wherein in the case where the recording material is a resin sheet, the discharge roller conveys the resin sheet at a third speed until the rear edge in the conveying direction of the resin sheet passes through the fixing nip portion, and the discharge roller conveys the resin sheet at a fourth speed higher than the third speed after the rear edge in the conveying direction passed through the fixing nip portion.

3. An apparatus according to claim 2, wherein the third speed is lower than the first speed.

4. An apparatus according to claim 3, wherein the fourth speed is the same as the second speed.

5. An apparatus according to claim 1, wherein the fixing portion and the discharge roller are driven by a same motor.

* * * * *